US011738531B1

(12) United States Patent
Sanchez et al.

(10) Patent No.: US 11,738,531 B1
(45) Date of Patent: Aug. 29, 2023

(54) TRASH COMPACTOR

(71) Applicants: Ernesto Sanchez, Arleta, CA (US); William Canale, Arleta, CA (US); Freddy Espinosa, Arleta, CA (US); Yolanda Flores, Arleta, CA (US); Sofia Gil, Arleta, CA (US)

(72) Inventors: Ernesto Sanchez, Arleta, CA (US); William Canale, Arleta, CA (US); Freddy Espinosa, Arleta, CA (US); Yolanda Flores, Arleta, CA (US); Sofia Gil, Arleta, CA (US)

( * ) Notice: Subject to any disclaimer, the term of this patent is extended or adjusted under 35 U.S.C. 154(b) by 58 days.

(21) Appl. No.: 17/493,560

(22) Filed: Oct. 4, 2021

Related U.S. Application Data

(63) Continuation-in-part of application No. 16/380,615, filed on Apr. 10, 2019, now abandoned.

(51) Int. Cl.
*B30B 1/04* (2006.01)
*B30B 9/30* (2006.01)
*B65F 1/14* (2006.01)

(52) U.S. Cl.
CPC ..... *B30B 9/3046* (2013.01); *B30B 1/04* (2013.01); *B30B 9/306* (2013.01); *B30B 9/3042* (2013.01); *B30B 9/3053* (2013.01); *B65F 1/1405* (2013.01)

(58) Field of Classification Search
CPC ..... B30B 9/00; B30B 9/321; B30B 9/306; B30B 9/3046; B30B 9/3053; B30B 1/00; B30B 15/062; B30B 9/3042; B30B 1/04; Y10S 100/902; Y10S 100/915; B65F 1/1405
USPC ..... 100/265, 266, 283, 902
See application file for complete search history.

(56) References Cited

U.S. PATENT DOCUMENTS

| | | | | |
|---|---|---|---|---|
| 4,248,144 | A * | 2/1981 | Morgan | B30B 1/30 100/270 |
| 5,094,157 | A | 3/1992 | Challis et al. | |
| 5,179,893 | A * | 1/1993 | Richardson | B30B 9/321 100/98 R |
| 5,293,816 | A * | 3/1994 | Musumeci, Sr. | B30B 9/321 100/291 |
| 5,417,154 | A * | 5/1995 | Plaats | B30B 9/321 100/283 |
| 5,584,239 | A | 12/1996 | Yelczyn et al. | |
| 2015/0075393 | A1* | 3/2015 | Ho | B65F 1/1405 100/245 |

* cited by examiner

*Primary Examiner* — Jimmy T Nguyen
(74) *Attorney, Agent, or Firm* — Sanchelima & Associates, P.A.; Christian Sanchelima; Jesus Sanchelima

(57) ABSTRACT

A trash compactor includes an enclosure assembly, a press assembly, and a lever assembly. The enclosure assembly includes a tray and an enclosure extending from the bottom end of the tray. Furthermore, the press assembly includes a press member disposed within the enclosure. The press member includes openings that receive rods therethrough. The rods being secured to opposing interior walls of the enclosure allowing the press member to slidably traverse an interior portion of the enclosure. A lever is then engaged with the actuating rod that is configured to be actuated by a user to compact trash placed within the enclosure.

11 Claims, 7 Drawing Sheets

TRASH COMPACTOR

BACKGROUND OF THE INVENTION

1. Other Related Applications

The present application is a continuation-in-part of pending U.S. patent application Ser. No. 16/380,615, filed on Apr. 10, 2019, which is hereby incorporated by reference.

2. Field of the Invention

The present invention relates to a trash compactor and, more particularly, to a manual trash compactor that includes a rectangular enclosure with an integral horizontal press that is operated by a pivoting lever.

3. Description of the Related Art

Several designs for trash compactor have been designed in the past. None of them, however, include expandable wings to retrofit the enclosure atop various receptacles.

Applicant believes that a related reference corresponds to U.S. Pat. No. 5,094,157 issued for a can crushing machine for use in the disposal of cans. Applicant believes that another related reference corresponds to the U.S. Pat. No. 5,584,239 issued for a hand operated can crusher. None of these references, however, teach of a trash compactor that includes a pivoting lever mounted to the exterior of the enclosure that can be used to actuate a horizontal press assembly.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a trash compactor that includes a manually operated lever to actuate a press that crushes refuse such as cans and bottles.

It is another object of this invention to provide a trash compactor that includes flap extensions that can be retrofitted atop trash receptacles of different widths and sizes.

It is still another object of the present invention to provide a trash compactor that includes an opening at the bottom of the enclosure to simultaneously remove refuse from said enclosure as it is crushed.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
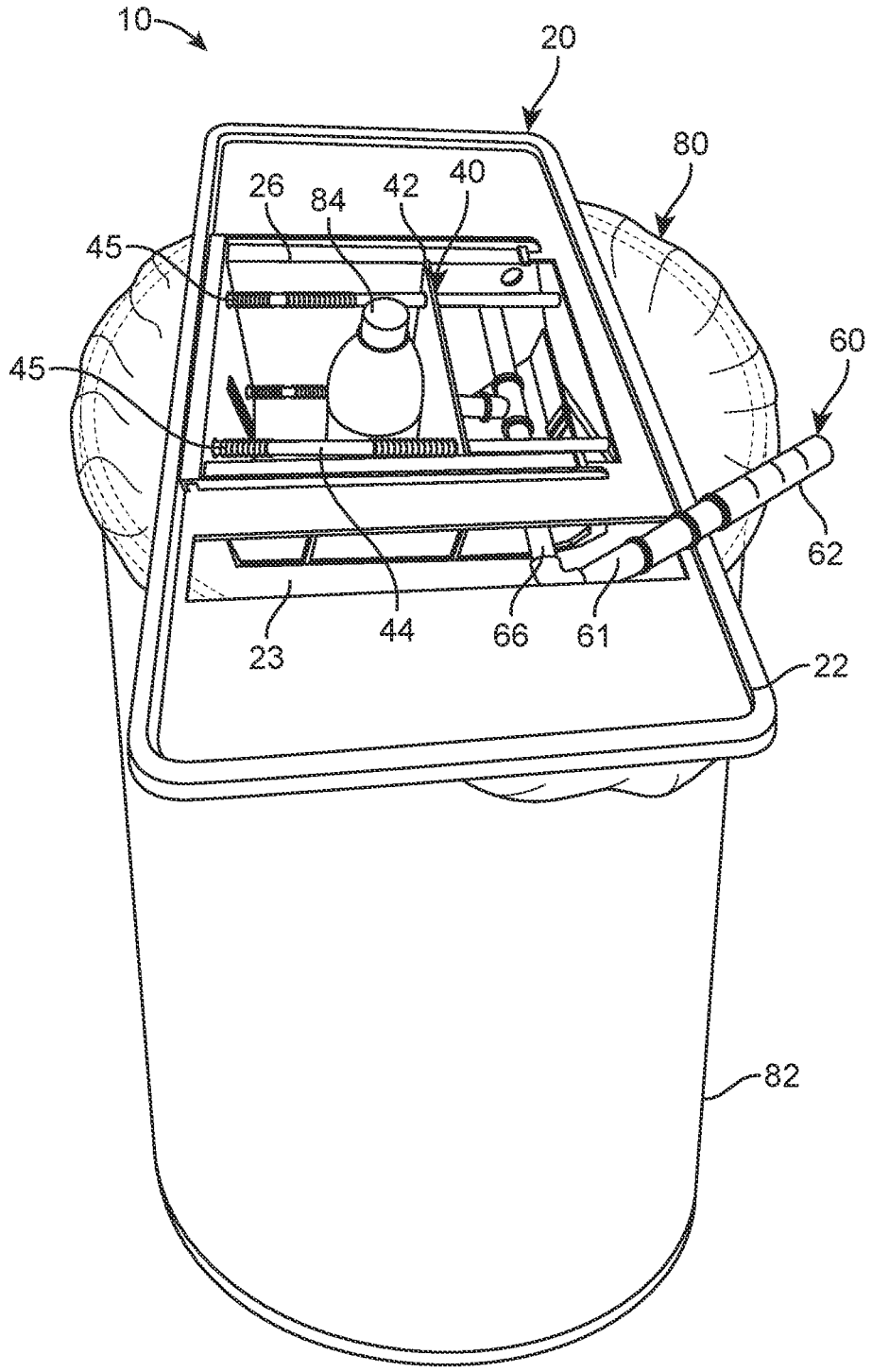
FIG. 1 represents an operative isometric view of the trash compactor 10 mounted onto a receptacle 82. The lever assembly 60 is shown with the lever 61 in a first position. When the lever 61 is actuated forward the press member 42 travels along the rods 44 to crush refuse such as a bottle 84 located within the enclosure 26. Circumferentially disposed about the rods 44 are springs 45. The springs 45 may help reset the press member 42 after the lever 61 has been actuated.

Referring now to the drawings, where the present invention is generally referred to with numeral 10, it can be observed that it basically includes an enclosure assembly 20, a press assembly 40, a lever assembly 60, and a receptacle assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
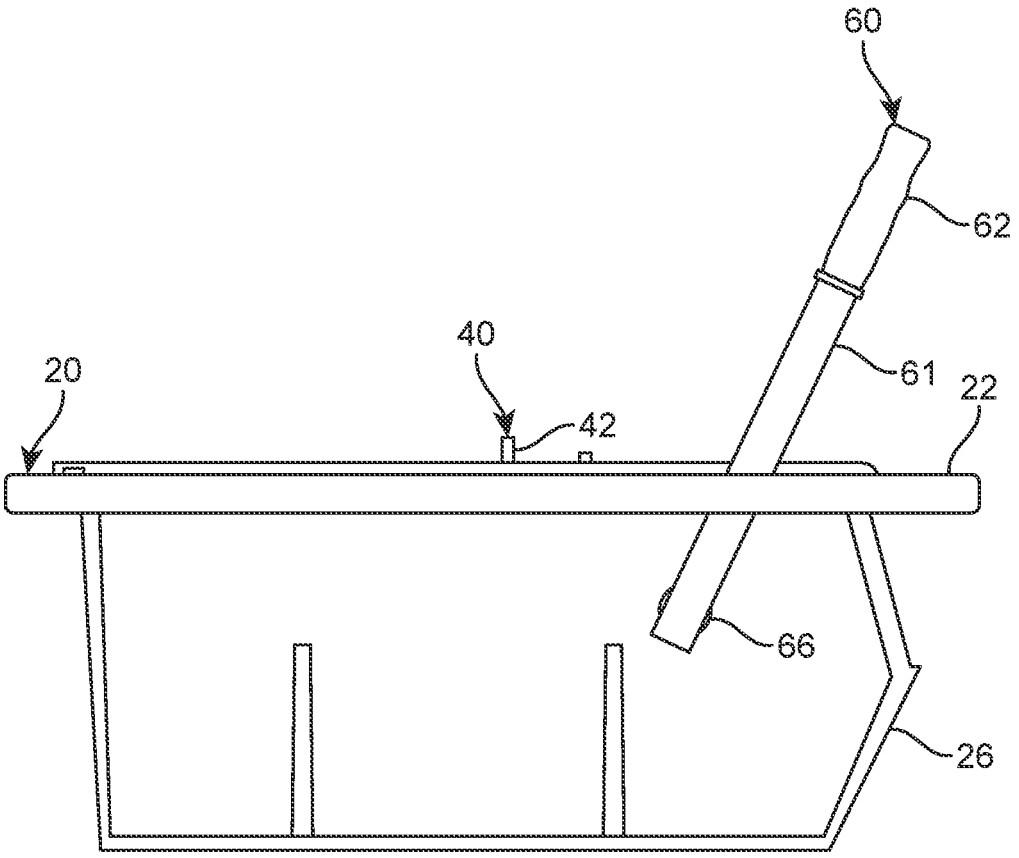
FIG. 2 shows a side view of the trash compactor 10 depicting the lever 61 of the lever assembly 60 operatively engaged with the actuating rod 66 that traverses a lateral wall of the enclosure 26. The lever 61 is received through a slit of the tray 22.
Figure 3:
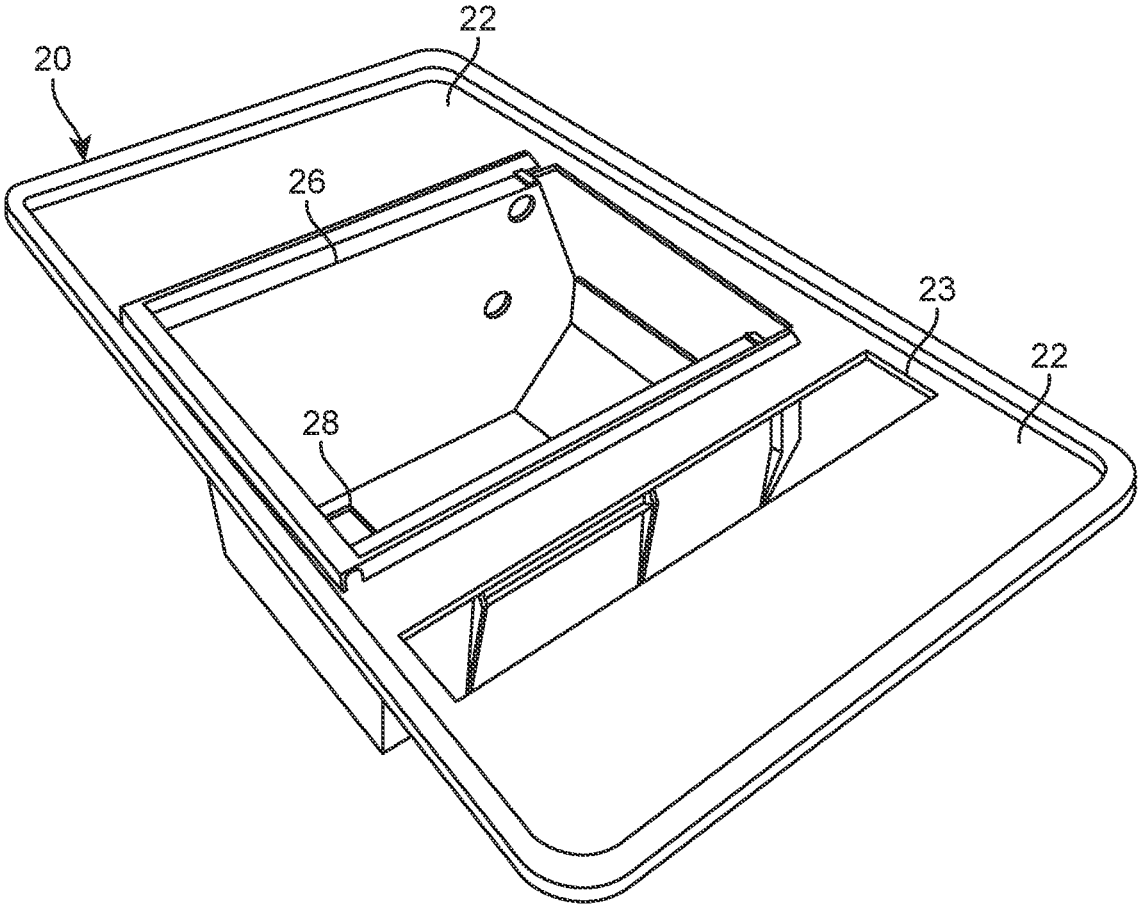
FIG. 3 illustrates an isometric view of the enclosure assembly 20 depicting a bottom opening 28 located at the bottom end of the enclosure 26. The bottom opening 28 may help automatically dispense crushed refuse.

Best illustrated in FIG. 1-3 the enclosure assembly 20 may include tray 22. The tray 22 may be a flattened member that includes four perimeter edges. The four perimeter edges of the tray 22 may include a raised ridge that protrudes perpendicularly upward. The raised ridge about the four perimeter edges of the tray 22 may provide a user a gripping point. Thereby allowing the user to mount the enclosure assembly 20 over various receptacles such as waste bins, shopping carts, or any variation thereof. It may be suitable for the tray 22 to be placed over a receptacle 82 of the receptacle assembly 80. Centrally located within the perimeter of the tray 22 may be an enclosure 26. The enclosure 26 may include four perimeter walls that extend downward from a bottom face of the tray 22. The tray 22 may further include a slit 23. The slit 23 may be a rectangular aperture that is coplanar to the open top portion of the enclosure 26. The enclosure 26 may further include a flattened horizontal bottom wall. Thereby allowing refuse, such as a bottle 82, to be placed within the enclosure 26. Located along the bottom wall of the enclosure 26 may be a bottom opening 28. The bottom opening 28 may be a rectangular opening that facilitates automatically dispensing refuse out of the enclosure 26 after it has been crushed and pushed forward by the press assembly 40.

Figure 4:
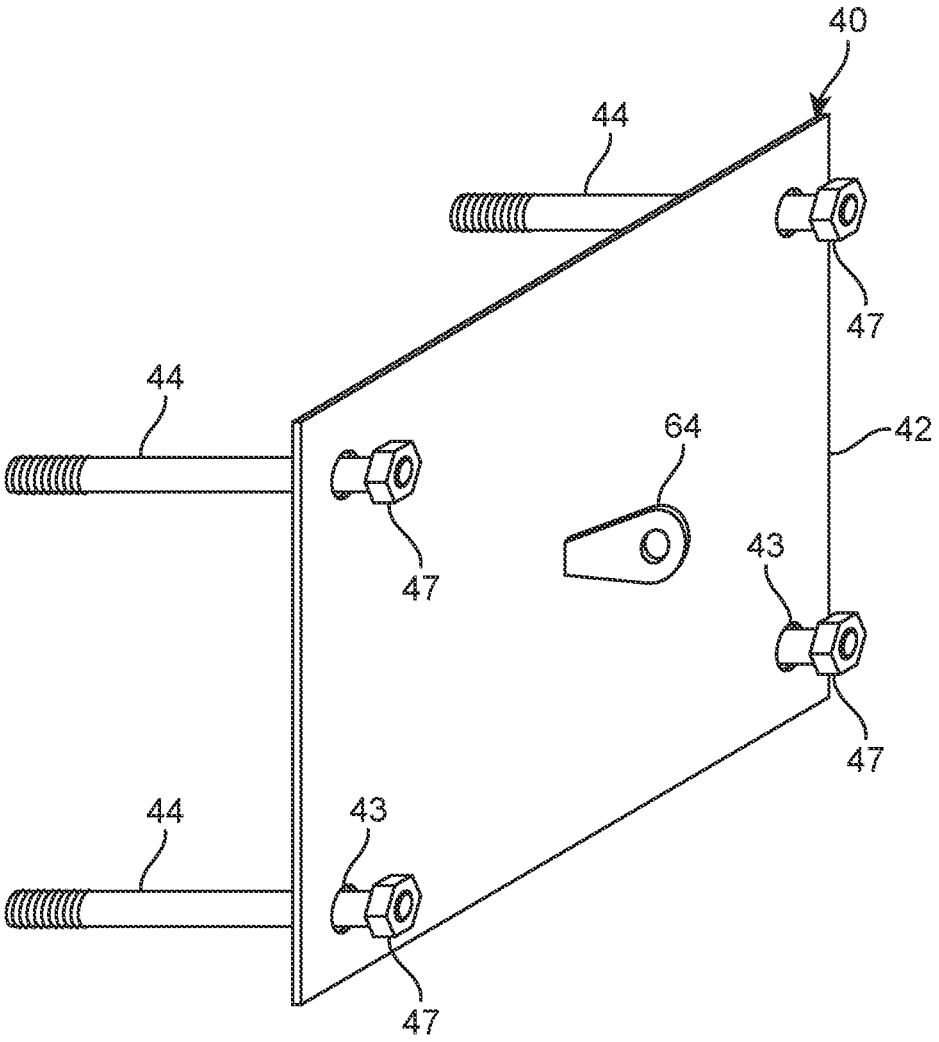
FIG. 4 is a representation of an isometric view of the press assembly 40 including the press member 42. Wherein the press member 42 includes an attachment point 64 to operatively engage with the actuating member 68 (not shown). The fasteners 47 help secure the rods 44 within the enclosure.
Figure 5:
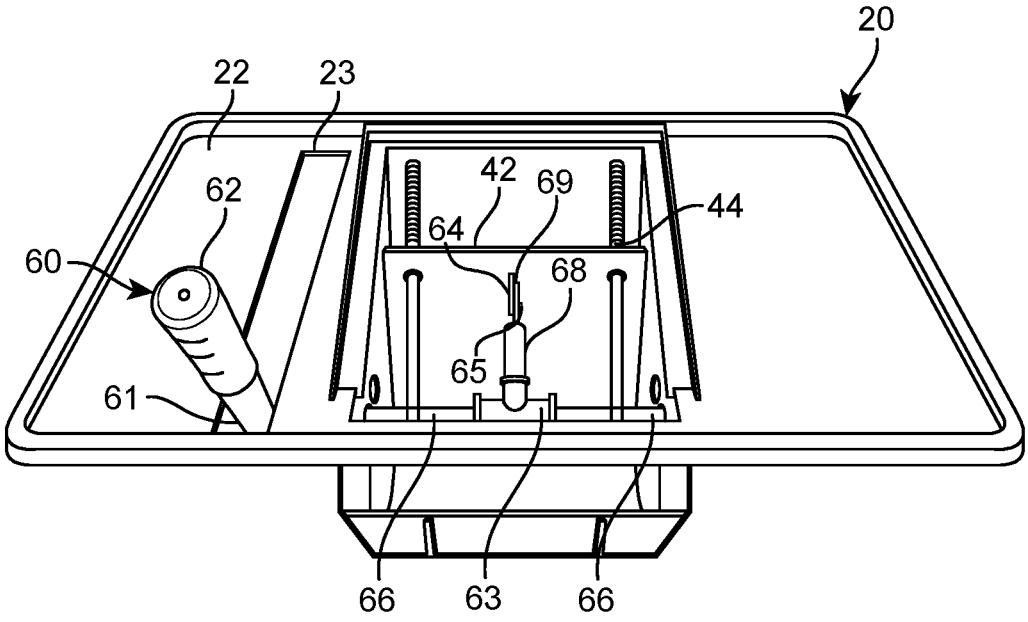
FIG. 5 is an isometric view of the lever 61 in a first position wherein a distal end of the actuating member 68 is shown between the press member 42 and the actuating rod 66. The actuating member 68 is engaged with the attachment point 64 located on the rear face of the press member 42.
Figure 6:
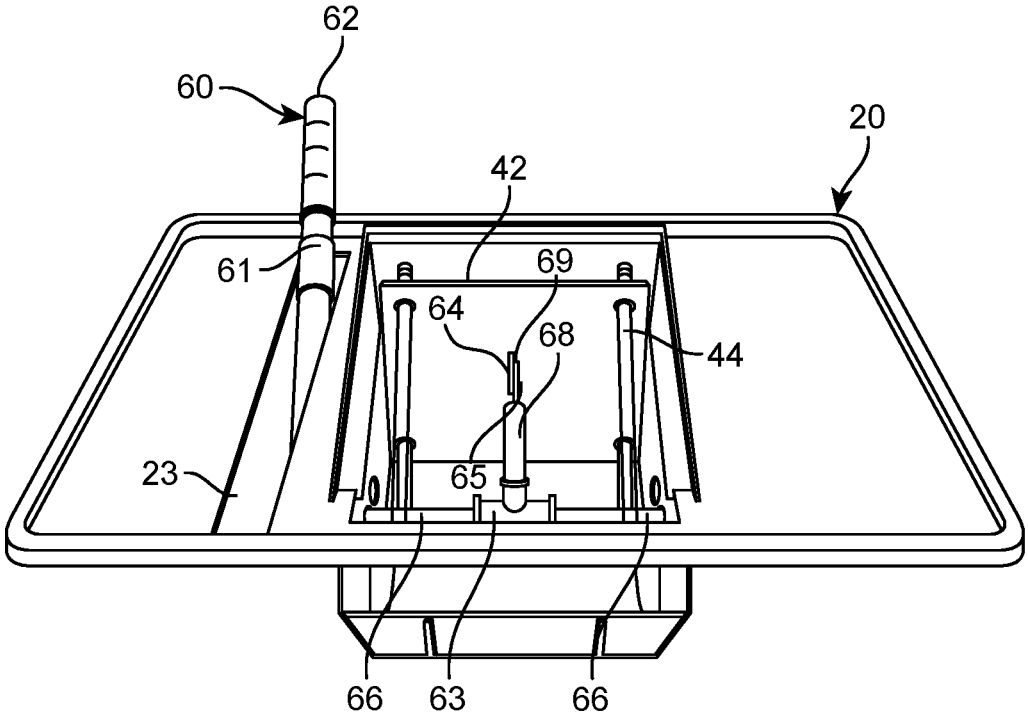
FIG. 6 depicts the lever 61 in a second position. The lever 61 has been actuated forward to urge the actuating member 68 to push the press member 42. Thereby translating the motion of the press member 42 along the enclosure to compress an article placed therein.

As shown in FIG. 4-6 the press assembly 40 may include a press member 42. In one embodiment the press member 42 may be a rigid member having a rectangular shape. Referring to FIG. 4, press member 42 may include a rear face with openings 43 disposed about corners of the press member 42. The openings 43 may be circular apertures that define through holes located on the press member 42. The openings 43 may receive rods 44 therein. Shown in FIG. 1 the rods 44 may be parallel cylindrical members that are secured to an interior front wall and interior rear wall of the enclosure 26. The rods 44 may help maintain the press member 42 in an upright position as it is urged forward via the lever assembly 60.

The rods 44 may further include springs 45 mounted thereon. The springs 45 may help reset the press member 42 to a resting position after it has been urged forward. In one embodiment, springs 45 may be a plurality of springs that move freely about the rods 45. Alternatively, it may also be suitable for the springs 45 to be secured to the front wall of the enclosure 26 to achieve the same result. In the current embodiment the springs 45 may be located entirely between a front face of the press member 42 and the front wall of the enclosure 26. Best shown in FIGS. 1 and 4 the rods 44 may traverse the rear face of the press member 42 and be secured to the enclosure 26 from an exterior portion via fasteners 47. Wherein the fasteners 47 may be wing nuts, hexagon nut, square nut, plate nut, or any variation thereof. The securing of the rods 44 to the enclosure 26 may help keep said rods 44 in parallel alignment. Thereby facilitating the movement of the press member 42 as it traverses the interior of the enclosure 26 when the lever assembly 60 is actuated.

Best illustrated in FIGS. 5 and 6 the lever assembly 60 may include a lever 61. The lever 61 may be a cylindrical rod including a handle 62 mounted to a top distal end. The handle 62 may include a rubberized surface to allow the user to better grip the lever 61. In one embodiment the lever 61 may perpendicularly traverse the slit 23 of the enclosure assembly 20. The lever 61 may be operatively engaged with the actuating rod 66 that traverses a first lateral wall of the enclosure 26. It may be suitable for the actuating rod 66 to be anchored to a second lateral wall of the enclosure 26. Wherein the actuating rod 66 is mounted parallel to the rear wall of the enclosure 26. The actuating rod 66 may be a cylindrical member that rotates forward and backward upon the actuation of the lever 61. Circumferentially mounted to a central portion of the actuating rod 66 may be a junction 63. The junction 63 may be an T-shaped member that is mounted to the actuating rod 66 in a fixed position. The junction 63 may include an interior that serves as a mounting point for the actuating member 68. The actuating member 68 may be a cylindrical member that extends perpendicularly outward with respect to the actuating rod 66. It may be suitable for the actuating member 68 to include a U-shaped cutout 69 located at a distal end. Wherein the U-shaped cutout 69 includes through holes on opposing lateral sides. The U-shaped cutout 69 of the actuating member 68 receiving the attachment point 64 therein. The attachment point 64 may be a flattened rounded member that includes an attachment point opening. The attachment point 64 may be mounted to the rear face of the press member 42 as best illustrated in FIG. 4. It may be suitable for the attachment point 64 to be received by the actuating member 68. Wherein the attachment point opening and the through holes of the U-shaped cutout 69 located on the actuating member 68 are in alignment. In one embodiment a pin 65 may traverse the attachment point opening and through holes of the U-shaped cutout 69 simultaneously. Thereby engaging the actuating member 68 to the attachment point 64. It may be suitable to secure the pin 65 in place via a cotter pin. The actuating member 68 may rotate about the pin when the lever 61 is urged forward and backward.

Demonstrated in FIGS. 5 and 6 respectively. It may be suitable for the lever 61 to include a first position and a second position. While in the first position the lever 61 may be resting on a rear edge of the slit 23. The first position may further include the actuating member 68 engaged to the attachment point 64 located on the rear face of the press member 42 thereby pulling the press member 42 to a rear most position within the enclosure 26. As shown in FIG. 6 the lever 61 may also be actuated forward by a user to place said lever 61 into a second position. The second position may include the lever 61 resting on the front edge of the slit 23. The actuating rod 66 may rotate forward as the lever 61 transitions from the first position to the second position. Thereby urging the actuating member 68 and by extension the press member 42 into a forward position to crush refuse that may be placed within the enclosure 26.

Figure 7:
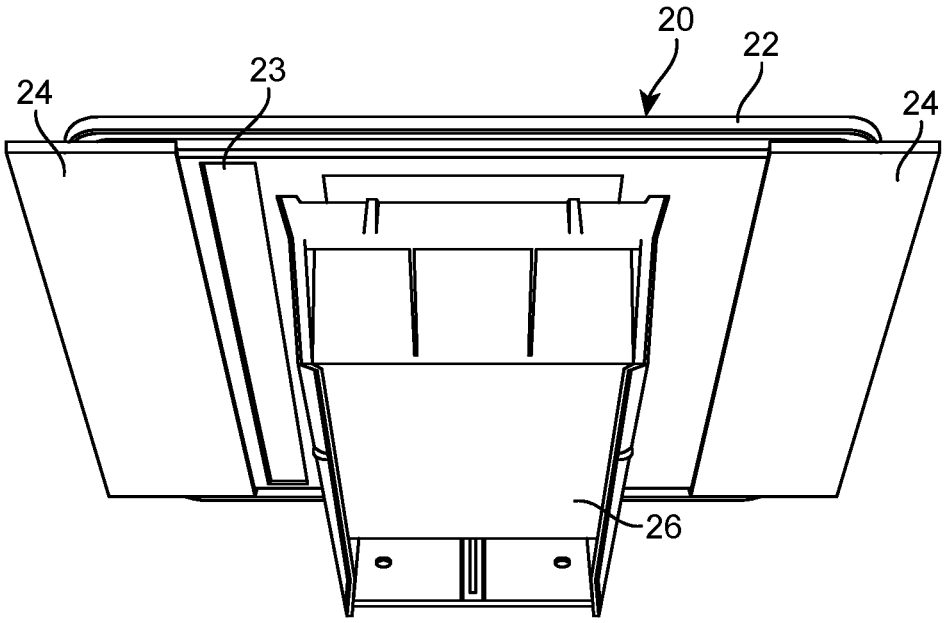
FIG. 7 demonstrates a bottom perspective view of an alternate embodiment of the enclosure assembly 20. Wherein the enclosure assembly 20 includes flap extensions 24 that are slidably mounted underneath the tray 22 on either side of the enclosure 26. The flap extensions 24 may aid in placing the present invention 10 over wider receptacles.
Figure 8:
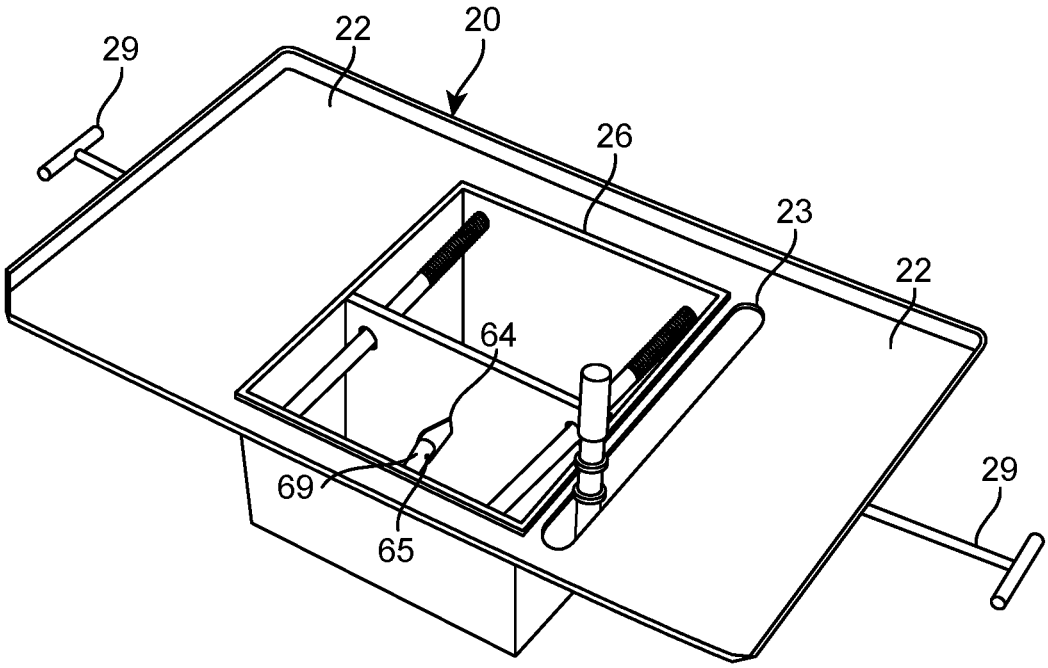
FIG. 8 shows a top-right perspective view of the enclosure assembly 20. Wherein the enclosure assembly 20 includes extension members 29. The extension members 29 are mounted underneath tray 22 on lateral sides of the enclosure 26. The extension members 29 may aid in placing the present invention 10 over wider receptacles.

As shown in FIG. 7 it may be suitable for the enclosure assembly to include flap extensions 24. The flap extensions 24 may be slidably mounted to a bottom portion of the tray 22 adjacent to the lateral sides of the enclosure 26. In an alternate embodiment shown in FIG. 8 the enclosure assembly 20 may include extension members 29. The extension members 29 may be t-shaped members mounted underneath the tray 22. The extension members 29 may extend outward and swivel downward. The flap extensions 24 and the extension members 29 may help a user accommodate the enclosure assembly 20 over receptacles with widths that exceed that of the tray 22.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a trash compactor, comprising:

a) an enclosure assembly including a tray and an enclosure, wherein the enclosure is protruding from a bottom end of the tray, said enclosure including a bottom opening, said tray including a slit;

b) a press assembly including a press member with a front face and a rear face fitted within the enclosure, said press member including openings that receive rods therethrough, wherein the press member is operatively engaged with the rods, the rods being secured to opposing walls within the enclosure; and c) a lever assembly including a lever operatively engaged with an actuating rod, wherein the lever is fitted within said slit and the actuating rod is disposed within the enclosure entirely behind said rear face of the press member, wherein an actuating member is coupled to the actuating rod and engages with an attachment point, wherein said attachment point is located on the rear face of the press member by means of an U-shaped cutout rotatably engaged thereto, wherein said U-shaped cutout is located at a distal end of said actuating member, wherein said lever is operated to rotate said actuating member forcing said press member to move back and forth in a straight-line motion.

2. The system for a trash compactor of claim 1, wherein said attachment point is a flattened circular member that extends perpendicularly from the rear face of the press member and includes an attachment point opening.

3. The system for a trash compactor of claim 1, wherein said tray is a flattened member including four perimeter edges.

4. The system for a trash compactor of claim 3, wherein said tray includes a raised protrusion along the four perimeter edges.

5. The system for a trash compactor of claim 1, wherein the tray includes flap extensions slidably mounted underneath said tray.

6. The system for a trash compactor of claim 1, wherein the tray includes extension members mounted underneath said tray.

7. The system for a trash compactor of claim 1, wherein said press member has a rectangular shape.

8. The system for a trash compactor of claim 1, wherein said rods include springs mounted thereon to facilitate resetting the press member after it has been urged forward.

9. The system for a trash compactor of claim 1, wherein said slit is a rectangular aperture.

10. A system for a trash compactor, comprising:

a) an enclosure assembly including a tray and an enclosure, wherein the enclosure is protruding from a bottom end of the tray, said enclosure including a bottom opening, said tray being a flattened member with four perimeter sides including a slit;

b) a press assembly including a press member with a front face and a rear face fitted within the enclosure, said press member including openings that receive rods therethrough, wherein the press member is operatively engaged with the rods, the rods being secured to opposing walls within the enclosure; and c) a lever assembly including a lever operatively engaged with an actuating rod, wherein the lever is fitted within said slit and the actuating rod is disposed within the enclosure entirely behind said rear face of the press member, wherein an actuating member is coupled to the actuating rod and engages with an attachment point, wherein said attachment point is located on the rear face of the press member by means of an U-shaped cutout rotatably engaged thereto, wherein said U-shaped cutout is located at a distal end of said actuating member, wherein said lever is operated to rotate said actuating member forcing said press member to move back and forth in a straight-line motion, said attachment point being a flattened circular member that includes an attachment point opening, wherein the attachment point extends perpendicularly from the rear face of the press member, wherein said attachment point and said U-shaped cutout are secured in alignment via a pin.

11. A system for a trash compactor, consisting of:

a) an enclosure assembly including a tray having four perimeter edges and an enclosure, said four perimeter edges including a raised protrusion, wherein the enclosure is protruding from a bottom end of the tray, said enclosure including a bottom opening, said tray being a flattened member with four perimeter sides including a slit in the form of a rectangular aperture, the tray further including flap extensions slidably mounted underneath said tray;

b) a press assembly including a press member with a front face and a rear face fitted within the enclosure, said press member having a flattened rectangular shape and including openings that receive rods therethrough, wherein the press member is operatively engaged with the rods, the rods being secured to opposing walls within the enclosure; and c) a lever assembly including a lever operatively engaged with an actuating rod, wherein the lever is fitted within said slit and the actuating rod is disposed within the enclosure entirely behind said rear face of the press member, wherein an actuating member is coupled to the actuating rod and engages with an attachment point, wherein said attachment point is located on the rear face of the press member by means of an U-shaped cutout rotatably engaged thereto, wherein said U-shaped cutout is located at a distal end of said actuating member, wherein said lever is operated to rotate said actuating member forcing said press member to move back and forth in a straight-line motion, said rods including springs mounted thereon to facilitate resetting the press member after it has been urged forward, said attachment point being a flattened circular member that includes an attachment point opening, wherein the attachment point extends perpendicularly from the rear face of the press member, wherein said attachment point and said U-shaped cutout are secured in alignment via a pin.

* * * * *